US005252285A

United States Patent [19]

Lock

[11] Patent Number: 5,252,285

[45] Date of Patent: Oct. 12, 1993

[54] PROCESS FOR MAKING SILK FIBROIN FIBERS

[75] Inventor: Robert L. Lock, Newark, Del.

[73] Assignee: E. I. Du Pont de Nemours and Company, Wilmington, Del.

[21] Appl. No.: 827,141

[22] Filed: Jan. 27, 1992

[51] Int. Cl.[5] ..... D01F 4/02

[52] U.S. Cl. ..... 264/202; 264/204; 264/211.11; 264/211.16

[58] Field of Search ..... 264/202, 204, 211.11, 264/211.16

[56] References Cited

U.S. PATENT DOCUMENTS

| | | | |
|---|---|---|---|
| Re. 22,650 | 6/1945 | Bley | 106/141 |
| 1,934,413 | 11/1933 | Esselen | 264/202 X |
| 2,107,959 | 2/1938 | Rossner et al. | 264/202 |
| 5,171,505 | 12/1992 | Lock | 264/202 |

OTHER PUBLICATIONS

U.S. patent application Ser. No. 07/618,505 filed on Nov. 28, 1990.

English Translation of Japanese Reference 57-4,723 published on Jan. 27, 1982.

English Translation of Japanese Reference 2-240,165 published on Sep. 25, 1990.

J. Magoshi, "Physical Properties and Structure of Silk: 4.Spherulites Grown from Aqueous Solution of Silk Fibroin", *Polymer*, vol. 18, pp. 643-646 (Jul. 1977).

Ichimura & Okuyama, "X-Ray Diffraction of Stretched Silk Fibroin Films of the Silk I Crystal Type", Sen'i Gakkaishi, vol. 45, No. 8, pp. 345-349 (1989).

Bhat and Ahirrao, "Investigation of the Structure of Silk Film Regenerated with Lithium Thiocyanate Solution", Journal of Polymer Science, vol. 21, pp. 1273-1280 (1983).

Jun Magoshi and Shigeo Nakamura, "Studies on Physical Properties and Structure of Silk, Glass Transition and Crystallization of Silk Fibroin", Journal of Applied Polymer Science, vol. 19, pp. 1013-1015 (1975).

*Primary Examiner*—Leo B. Tentoni

[57] ABSTRACT

The present invention relates to a process for spinning silk fibers. The process involves dissolving silk fibroin in an aqueous salt solution, removing the salt from the solution, followed by removal of the water to form a regenerated silk material. The silk material is then dissolved in hexafluoroisopropanol to form a fiber-spinnable solution.

8 Claims, No Drawings

PROCESS FOR MAKING SILK FIBROIN FIBERS

BACKGROUND OF THE INVENTION

1. Field of the Invention

The present invention relates to a process for spinning silk fibers. More specifically, the invention involves forming silk fibers by dissolving silk fibroin in an aqueous salt solution, removing the salt from the solution, followed by removal of the water, and redissolution of the resulting regenerated silk in hexafluoroisopropanol (HFIP) to produce a fiber-spinnable solution. The solution can be spun and drawn to produce high-quality fibers with near-native silk properties having greater mechanical strength.

2. Description of the Related Art

Silk fibroin (silkworm silk) is a naturally occurring polypeptide which occurs in fibrous form having high strength and a soft hand. The nature of silk fibroin makes it suitable for a wide range of uses including textile applications and in suture materials. Silk has been used as a suture material since ancient times. Because silkworms produce filaments in only one size (ca. 1 denier), twisted or braided yarns must be used when loads exceed a few grams. Unfortunately, the interstices of a multifilament yarn can be a route for infection. Thus, it would be desirable to be able to produce silk fibers in deniers other than those found in nature which would be suitable for such applications as monofilament sutures.

Fibroin is known to be soluble in certain high ionic strength aqueous salt solutions, for example, aqueous lithium thiocyanate (LiSCN), sodium thiocyanate (NaSCN), calcium thiocyanate ($Ca(SCN)_2$), magnesium thiocyanate ($Mg(SCN)_2$), calcium chloride ($CaCl_2$), lithium bromide (LiBr), zinc chloride ($ZnCl_2$), magnesium chloride ($MgCl_2$), and copper salts, such as copper nitrate ($Cu(NO_3)_2$), copper ethylene diamine ($Cu(NH_2CH_2CH_2NH_2)_2(OH)_2$), and $Cu(NH_3)_4(OH)_2$. It has long been known that the salts can be dialyzed out of such aqueous salt/fibroin solutions to produce aqueous solutions of fibroin which are similar in some ways to the liquid contents of a silkworm's silk gland. Fibers have been spun from aqueous fibroin solutions of this type, but more commonly, the solutions have been used to cast films for structure studies.

For example, Bhat and Ahirrao, *Journal of Polymer Science* Vol. 21, pp. 1273–1280 (1983) describe the dissolution of silk fibers in 70% lithium thiocyanate solution and regenerating the dissolved silk by casting films from the solution after dialyzing. They found that the cast films were amorphous and could o be transformed to a beta-sheet form using a variety of methods.

Those skilled in the art have attempted to find suitable solvents for preparing silk fibroin solutions which may be subsequently spun into fibers.

For example, Otoi et al., Japanese Kokoku Patent No. SHO 57[1982]-4723 describe a method for preparing a silk spinning solution involving dissolution of fibroin in an aqueous solution of copper-ethylenediamine, copper hydroxide-ammonia, copper hydroxide-alkali-glycerin, lithium bromide, sodium thiocyanate, or nitrates or thiocyanates of zinc, calcium, or magnesium. The solution is then dialyzed using a multilayered structure and used to fabricate fibers or films.

Bley, U.S. Pat. No. RE 22,650, discloses preparing fiber-spinnable polypeptide solutions containing a protein selected from the group consisting of silk fibroin, casein, gelatin, wool, and alginic acid in a solvent selected from quaternary benzyl-substituted ammonium bases.

U.S. Pat. No. 4,171,505 (Lock) describes a process for spinning polypeptide fibers including preparing fibers from a spinnable solution of silk fibroin in a solvent mixture of formic acid and lithium chloride.

Although it has been possible to produce silk fibroin fibers from such spinning solutions as described above, these solvents tend to be harsh and may degrade the fibroin. Dichloroacetic acid and trifluoroacetic acid are especially harsh and subject the polymer to a measurable degree of degradation. Fibers prepared from such solutions tend to be deficient in certain physical properties, such as mechanical strength.

Thus, a desirable solvent for preparing silk fibroin solutions is hexafluoroisopropanol (HFIP), because there is no detectable degradation of the fibroin in this solvent. However, in the past, it has not been possible to prepare silk fibers from HFIP solutions, since natural silk fibroin is not soluble in this solvent. Now, in accordance with this invention, a method for preparing silk fibroin fibers from silk fibroin/HFIP solutions has been discovered.

SUMMARY OF THE INVENTION

The present invention relates to a process for producing silk fibroin fibers. The process involves forming a silk fibroin solution of fibroin in an aqueous salt solution and removing the salt and water from the solution to form a fibroin material, such as a film. A fiber-spinnable solution comprising about 5 to 25% by weight of the silk fibroin material in hexafluoroisopropanol is then formed and extruded through a spinneret orifice to form a silk fiber.

Preferably, the aqueous salt solution includes a salt compound selected from the group consisting of lithium thiocyanate, copper (ethylene diamine) hydroxide, and zinc chloride. The salt may be removed by dialysis. The solution may be spun into fibers by wet-spinning, dry-jet wet spinning, or dry-spinning techniques. The invention also includes fiber-spinnable solutions and fibers produced from this process.

DETAILED DESCRIPTION OF THE INVENTION

In native fiber-form, silk fibroin is not soluble in hexafluoroisopropanol (HFIP), thus fibers cannot be spun from these solutions. It is believed that the density of hydrogen bonding between highly oriented polymer molecules in the beta-sheet structure of the fiber provides more cohesion than the solvent, HFIP, can overcome.

The present invention provides a method for producing fibers from natural silk fibroin / HFIP solutions. The silk is "respun" into fibers under conditions which do not result in polymer degradation, loss of molecular weight, and consequent loss of fiber physical properties. The silk fibers of this invention are chemically similar to native silkworm silk but have filament deniers, filament cross sections, etc., not o found in nature.

The process of the current invention involves the steps of 1) dissolution of silk fibroin which is insoluble in HFIP in an aqueous salt solution, 2) removal of the salt, 3) removal of the water to yield fibroin which is now soluble in HFIP, and 4) dissolution in HFIP, followed by spinning of the solution through a spinneret orifice to obtain silk fibers.

It is preferable to purify the silk fibroin prior to dissolving in the aqueous salt solution. Methods for purification of fibroin are well known in the art.

The aqueous salt solution may be any of those known in the art for dissolving silk fibroin. The preferred salts are lithium thiocyanate, copper-(ethylene diamine) hydroxide and zinc chloride. Salts which may also be used include the nitrate, chloride and thiocyanate salts of calcium, magnesium, and zinc, and copper salts such as $Cu(NH_3)_4(OH)_2$. The concentration of salt in the solution must be sufficient to dissolve the fibroin. Concentrations of salt in the range of about 40 to 80 weight percent (wt. %) are preferred.

It is preferable to dissolve the fibroin at room temperature, however elevated temperatures may be used, up to about 80° C., in order to increase the rate of dissolution. Heating should not be conducted at a temperature at which the fibroin may be degraded. Fibroin solutions in aqueous lithium thiocyanate are stable on standing several days. Preferably, the concentration of silk fibroin in the aqueous salt solution is in the range of about 5 to 40 weight percent. If the concentration of fibroin is less than about 5 weight percent, the solution is difficult to handle, since the salt must be dialyzed and high amounts of water removed. If the concentration of fibroin is greater than about 40 weight percent, the solution is difficult to handle because of its high viscosity.

Once the fibroin is dissolved in the salt solution, the salt is removed using methods known in the art. Preferably, this removal is done by dialysis of the solution.

The fibroin is isolated from the desalted or dialyzed solution by removal of the water. This may be done using a number of methods known in the art. A convenient means is by casting of films and removal of the water by evaporation. The solution may also be lyophilized or spray dried, or the solvent removed in a rotary evaporator.

Surprisingly, the resulting regenerated fibroin material is readily soluble in HFIP, whereas it was not soluble prior to the dissolution process described above. It is believed that the fibroin molecules in the films cast from the aqueous solutions of this invention are typically not in highly oriented beta-sheets and are therefore not extensively involved in high-density hydrogen bonding. This reduced crystalline structure of the fibroin allows it to be re-dissolved in HFIP solution from which fibers may be spun. It has been found that films as old as six months can be readily dissolved in HFIP.

Preferably, the HFIP solution is prepared by dissolving the regenerated fibroin in the HFIP solvent at room temperature. The solutions may be safely heated at temperatures up to about 30° C. for several hours if desired. Concentrations of the fibroin should be such as to yield fiber-spinnable solutions. Concentrations of about 5 to 25 weight percent have been found to be useful, with concentrations of 10 to 20 weight percent being preferred.

The spinnable solution may then be spun into fibers using elements of processes known in the art. These processes include, for example, wet spinning, dry-jet wet spinning, and dry spinning. Wet spinning is preferred as it is the simpler of these processes.

In a wet spinning process, the spinning solution is extruded directly into a coagulating bath. The coagulant may be any fluid wherein the hexafluoroisopropanol is soluble, but wherein the silk is insoluble. Examples of suitable coagulating fluids include water, methanol, ethanol, isopropyl alcohol, and acetone. Methanol has been found to be the preferred coagulating fluid. The fibers may be cold drawn while still wet with coagulating fluid. Preferably, the fibers are dried under tension in order to prevent shrinkage and to obtain improved tensile properties.

In a dry-jet wet spinning process, the spinning solution is attenuated and stretched in an inert, non-coagulating fluid, e.g., air, before entering the coagulating bath. Suitable coagulating fluids are the same as those used in a wet spinning process.

In a dry spinning process, the spinning solution is not spun into a coagulating bath. Rather, the fibers are formed by evaporating the solvent into an inert gas which may be heated.

Testing Methods

Physical properties such as tenacity, elongation, and initial modulus were measured using methods and instruments which conformed to ASTM Standard D 2101-82, except that the test specimen length was one inch. Five breaks per sample were made for each test.

The following examples further describe the invention but should not be construed as limiting the scope of the invention. In these examples, parts and percentages are by weights, unless otherwise indicated.

EXAMPLE

Preparation of Degummed Silk Fibroin

Purified silk fibroin may be prepared from raw reeled silk yarn or from cocoons which have been cut open, had the pupae removed, and been picked clean of foreign vegetative matter.

Purified silk fibroin was prepared from raw reeled silk yarn by boiling a 160 g hank at reflux in 3.3 liters of deionized water with 1.75 g sodium carbonate and 10.5 g powdered "Ivory" soap for 1.5 hours. After boiling, the silk was removed from the water, wrung out, and rinsed twice in 3 liter portions of hot deionized water. The rinsed silk was then boiled again at reflux in 3.3 liters of deionized water with 0.66 g sodium carbonate for 1 hour, removed, wrung out, and rinsed twice in 3 liter portions of hot deionized water. Finally, the silk was wrung out thoroughly, soaked ½ hour in each of two 1 liter portions of methanol, wrung thoroughly, and allowed to dry in the room temperature air flow of a laboratory fume hood. The product was 124.5 g purified silk fibroin, still in fiber form.

Physical testing of the silk fibroin filaments showed them to be 0.66–1.04 dtex (0.59–0.94 denier), 0.86 dtex average (0.77 denier) with tenacities of 3.21–4.23 dN/tex (3.64–4.79 gpd (grams per denier)), 3.84 dN/tex average (4.35 gpd), elongations of 11.5–31.2% (20.5 % average), and initial moduli of 59.5–77.5 dN/tex (67.4–87.8 gpd), 70.0 dN/tex average (78.1 gpd).

Preparation of Lithium Thiocyanate/Fibroin Solution.

A stock solution was prepared by dissolving 100 g lithium thiocyanate hydrate ($LiSCN \times H_2O$, Aldrich, ca. 60 wt. % LiSCN / 40 wt. % $H_2O$) in 43 g deionized water. The solution was filtered to remove insoluble contaminants.

A solution of 20% silk fibroin in aqueous lithium thiocyanate was prepared by mixing 10.29 g purified silk fibroin, above, with 41.02 g of the LiSCN stock solution in a small plastic packet made by heat-sealing sheets of 5 mil polyethylene film. The mixture initially became thick and foamy as the silk fiber disintegrated and dissolved. However, on standing three days with intermittent vigorous mixing, the mixture became a clear, viscous, pale amber solution.

Dialysis of Lithium Thiocyanate/Fibroin Solution.

An aqueous solution of silk fibroin was prepared by dialyzing the lithium thiocyanate solution above.

The solution of silk fibroin in aqueous lithium thiocyanate was filtered through a stack of stainless steel screens of 50, 325, 325, and 50 mesh and transferred into two (ca. 25 cm) lengths of 32 mm flat width "Spectrapor" viscose process cellulose dialysis tubing with 12–14,000 molecular weight cutoff. Tubing ends were sealed with clamps. Dialysis was carried out by placing the cellulose membrane tubes containing the silk/LiSCN solution into a shallow pan of deionized water and allowing a trickle of deionized water to flow into the pan and overflow into a drain. After 20 hours, the dialysis was considered complete. The resulting solution of silk fibroin in water was nearly clear and quite free-flowing but had very unusual surface tension properties, like a thin egg white. It was slightly sticky to the touch, and readily picked up small, quite stable air bubbles.

Casting of Fibroin Film

The aqueous solution of silk fibroin prepared by dialysis above was spread on flat polyethylene sheets using a 20 mil doctor knife and allowed to stand in room air to dry overnight. This produced 9.19 g of thin, transparent, slightly sticky, cellophane-like silk fibroin film.

Preparation of Fibroin HFIP Solution

A solution containing 14.9% silk fibroin film in the solvent hexafluoroisopropanol (HFIP) was prepared by adding 5.70 g HFIP to 1.00 g of film in a heat-sealed polyethylene packet, mixing thoroughly, and allowing the mixture to stand for 8 days with intermittent vigorous mixing. The solution was thick, clear, and a light yellowish pink in color.

Wet Spinning of Silk Fibers from HFIP Solution

The solution of silk fibroin in HFIP was transferred to a syringe fitted with a stainless steel screen pack consisting, in order, of 50, 325, 325, and 50 mesh screens. The syringe was capped and centrifuged to disengage air bubbles trapped in the solution. A syringe pump was then used to force the solution through the screen pack and out of the syringe through a 5 mil (0.013 cm) diameter by 10 mil (0.025 cm) length orifice in a stainless steel spinneret directly into a container of methanol at room temperature. The syringe pump was set to deliver the solution at a rate of 0.0136 ml/min. The filament which formed as the solution was extruded into methanol was allowed to fall freely and to coil on itself at the bottom of the container.

The coiled filament was allowed to stand in methanol overnight. Then, while still wet with methanol, the filament was drawn to 4× its length. The ends of the drawn fiber were fixed in place to prevent shrinkage during drying in room air.

Physical testing of samples of the dry fiber showed them to be 24.4–29.4 dtex (22.0–26.5 denier), 27.4 dtex average (24.7 d) with tenacities of 3.83–4.81 dN/tex (4.34–5.45 gpd), 4.20 dN/tex average (4.76 gpd), elongations of 8.2–9.3% (8.9% average), and initial moduli of 78.4–126.1 dN/tex (88.8–142.8 gpd), 101.1 dN/tex average (114.5 gpd). The above figures indicate that the tenacity and modulus of the "respun" silk fiber exceeded the tenacity and modulus of the native silk fiber.

COMPARATIVE EXAMPLE A

This example demonstrates the insolubility of natural silk fiber in hexafluoroisopropanol (HFIP).

An attempt was made to dissolve purified silk fibroin fiber directly in HFIP. 0.763 g of purified fiber was mixed with 4.35 g of HFIP in a heat-sealed polyethylene packet. The solvent had essentially no effect on the fiber beyond a slight swelling, even after 1 month. Gentle heating (to 40° C.) also produced no apparent changes.

I claim:

1. A process for producing silk fibroin fibers, comprising the steps of:

a) forming a silk fibroin solution comprising silk fibroin in an aqueous salt solution;

b) removing the salt and water from the fibroin solution to form a silk fibroin material;

c) forming a fiber-spinnable solution comprising about 5 to 25% by weight of the silk fibroin material in hexafluoroisopropanol; and d) extruding the fiber-spinnable solution through a spinneret to form silk fibroin fibers.

2. The process of claim 1, wherein the aqueous salt solution comprises a salt compound selected from the group consisting of lithium thiocyanate, copper(ethylene diamine) hydroxide, and zinc chloride.

3. The process of claim 2, wherein the salt compound is lithium thiocyanate.

4. The process of claim 1, wherein the salt is removed by dialysis, and the water is evaporated to form a silk fibroin film.

5. The process of claim 1, wherein the solution is extruded directly into a liquid coagulating medium to remove the hexafluoroisopropanol.

6. The process of claim 1, wherein the solution is extruded into an inert, non-coagulating fluid, and then into a liquid coagulating medium to remove the hexafluoroisopropanol.

7. The process of claim 5 or 6, wherein the liquid coagulating medium is methanol.

8. The process of claim 1, wherein the solution is extruded into an inert gas to remove the hexafluoroisopropanol.

* * * * *